US005087053A

United States Patent [19]

Head

[11] Patent Number: 5,087,053

[45] Date of Patent: Feb. 11, 1992

[54] ARCHERY TARGET APPARATUS

[76] Inventor: Robert H. Head, Rd. 1, Box 261, Callicoon, N.Y. 12723

[21] Appl. No.: 719,622

[22] Filed: Jun. 24, 1991

[51] Int. Cl.[5] ..... F41J 9/02

[52] U.S. Cl. ..... 273/359; 273/378; 273/407; 273/408

[58] Field of Search ..... 273/359, 378, 379, 403, 273/407, 408, 355, 361, 362, 363, 364, 365

[56] References Cited

U.S. PATENT DOCUMENTS 1,471,521 10/1923 Meininghaus ..... 273/359
3,486,752 12/1969 Colvin et al. ..... 273/378
3,823,939 7/1974 Bottorff ..... 273/359 X
4,345,765 8/1982 Wang ..... 273/359
4,911,453 3/1990 Essex et al. ..... 273/359

*Primary Examiner*—William H. Grieb
*Attorney, Agent, or Firm*—Leon Gilden

[57] ABSTRACT

A rolling target is initially mounted at an upper end of a ramp structure that is elevationally adjustable relative to a support organization. The release mechanism includes a gate flange biased in a retracted orientation relative to the ramp and maintained in an orthogonal orientation across the ramp by a latch member that is selectively released by a pneumatic mechanism. The target apparatus includes a tire structure, with a central opening mounting a framework therewithin, wherein the framework is arranged for securement of a target.

4 Claims, 6 Drawing Sheets

ARCHERY TARGET APPARATUS

BACKGROUND OF THE INVENTION

1. Field of the Invention

The field of invention relates to archery apparatus, and more particularly pertains to a new and improved archery target apparatus wherein the same is arranged for providing a moving target to enhance proficiency in the use of archery apparatus.

2. Description of the prior Art

Archer practice is typically directed at stationary targets wherein the utilization of moving targets is desirable to enhance proficiency in the simulation of hunting situations to improve proficiency relative to moving game targets.

Prior art structure arranged for association with moving targets is exemplified in the prior art in U.S. Pat. No. 4,911,453 to Essex, et al. wherein a target system utilizes a target supporting structure movable to effect projection of a target in a shooting sport.

U.S. Pat. No. 4,345,765 to Wang sets forth a moving target for use in a gallery arrangement wherein the targets are projected upwardly relative to a support structure.

U.S. Pat. No. 3,823,939 to Bottorff sets forth a football practice apparatus wherein various net members are moved along a track, wherein a football is projected at the net member.

U.S. Pat. No. 1,471,521 to Meininghaus sets forth a target apparatus wherein a target is instantaneously popped up for providing a target for a sporting event.

As such, it may be appreciated that there continues to be a need for a new and improved archery target apparatus as set forth by the instant invention which addresses both the problems of ease of use as well as effectiveness in construction in providing a moving target structure for use in an archery practice event and in this respect, the present invention substantially fulfills this need.

SUMMARY OF THE INVENTION

In view of the foregoing disadvantages inherent in the known types of target apparatus now present in the prior art, the present invention provides an archery target apparatus wherein the same utilizes a tire selectively secured and subsequently released along a ramp structure to provide a central target for use by an archery practicing individual. As such, the general purpose of the present invention, which will be described subsequently in greater detail, is to provide a new and improved archery target apparatus which has all the advantages of the prior art target apparatus and none of the disadvantages.

To attain this, the present invention provides a rolling target initially mounted at an upper end of a ramp structure that is elevationally adjustable relative to a support organization. The release mechanism includes a gate flange biased in a retracted orientation relative to the ramp and maintained in an orthogonal orientation across the ramp by a latch member that is selectively released by a pneumatic mechanism. The target apparatus includes a tire structure, with a central opening mounting a framework therewithin, wherein the framework is arranged for securement of a target.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery target apparatus which has all the advantages of the prior art target apparatus and none of the disadvantages.

It is another object of the present invention to provide a new and improved archery target apparatus which may be easily and efficiently manufactured and marketed.

It is a further object of the present invention to provide a new and improved archery target apparatus which is of a durable and reliable construction.

An even further object of the present invention is to provide a new and improved archery target apparatus which is susceptible of a low cost of manufacture with regard to both materials and labor, and which accordingly is then susceptible of low prices of sale to the consuming public, thereby making such archery target apparatus economically available to the buying public.

Still yet another object of the present invention is to provide a new and improved archery target apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
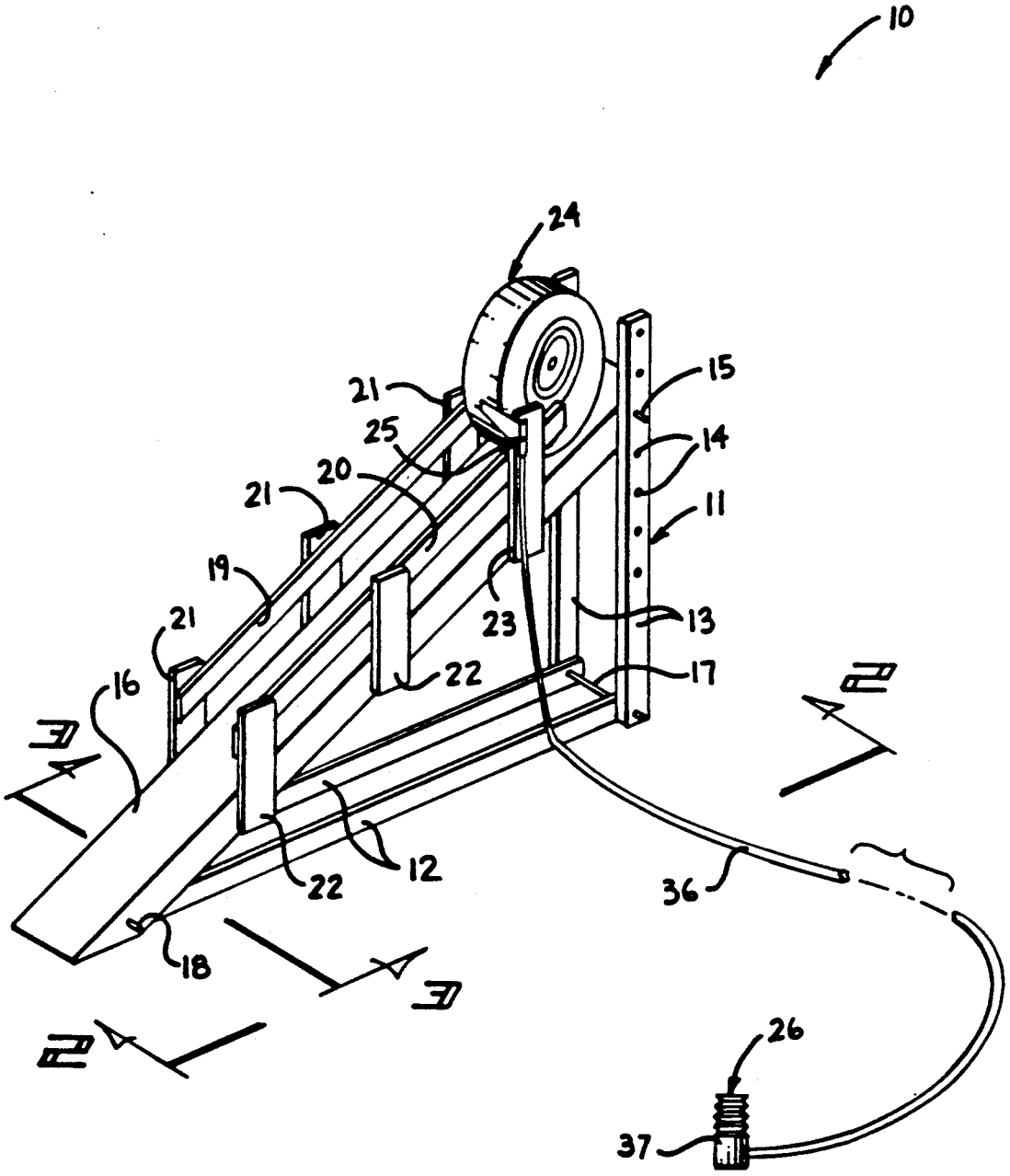
FIG. 1 is an isometric illustration of the instant invention.

With reference now to the drawings, and in particular to FIGS. 1 to 8 thereof, a new and improved archery target apparatus embodying the principles and concepts of the present invention and generally designated by the reference numeral 10 will be described.

More specifically, the archery target apparatus 10 of the instant invention essentially comprises a support rack 11 that includes a plurality of base legs 12, with each base leg removably mounting a rear support post 13 orthogonally relative to the rear terminal end of each base leg utilizing a second pin connector 17 interconnecting the rear terminal ends of the base legs 12 and the lower terminal ends of each mounting post 13. The mounting posts 13 each include a series of equally spaced apertures 14 directed orthogonally through each mounting post, wherein the apertures 14 of each mounting post are coaxially aligned relative to one another to receive a first pin connector 15 selectively through a pair of aligned apertures 14 of the spaced mounting posts 13 to be directed through an upper terminal end of a ramp member 16. The lower terminal end of the ramp member 16 receives a third pin connector 18 therethrough and through the forward terminal ends of the base legs 12. A right rail 19 is spaced from and parallel a left rail 20 to guide and direct a cylindrical tire member 24 therebetween and maintain the tire member on the ramp member 16 when released from an upper terminal end of the ramp 16, as illustrated in FIG. 1 for example. A plurality of right support posts 21 mounted to a right side of the ramp 16 mounts the right rail 19, wherein a plurality of left support posts 22 mounted to a left side of the ramp 16 mounts the left rail 20, wherein a top left support post 23 positioned adjacent an upper terminal end of the ramp 16 includes a latch mechanism 25 for selective release of the tire member 24 relative to the ramp 16. A pneumatic release member 26 configured as a pneumatic pump 37 is operative through a pneumatic conduit 36 to effect selective release of the latch mechanism 25. The cylindrical tire member 24 includes a central cylindrical tire opening 27 mounting a target 28 therewithin complementarily received within the tire opening 27.

Figure 2:
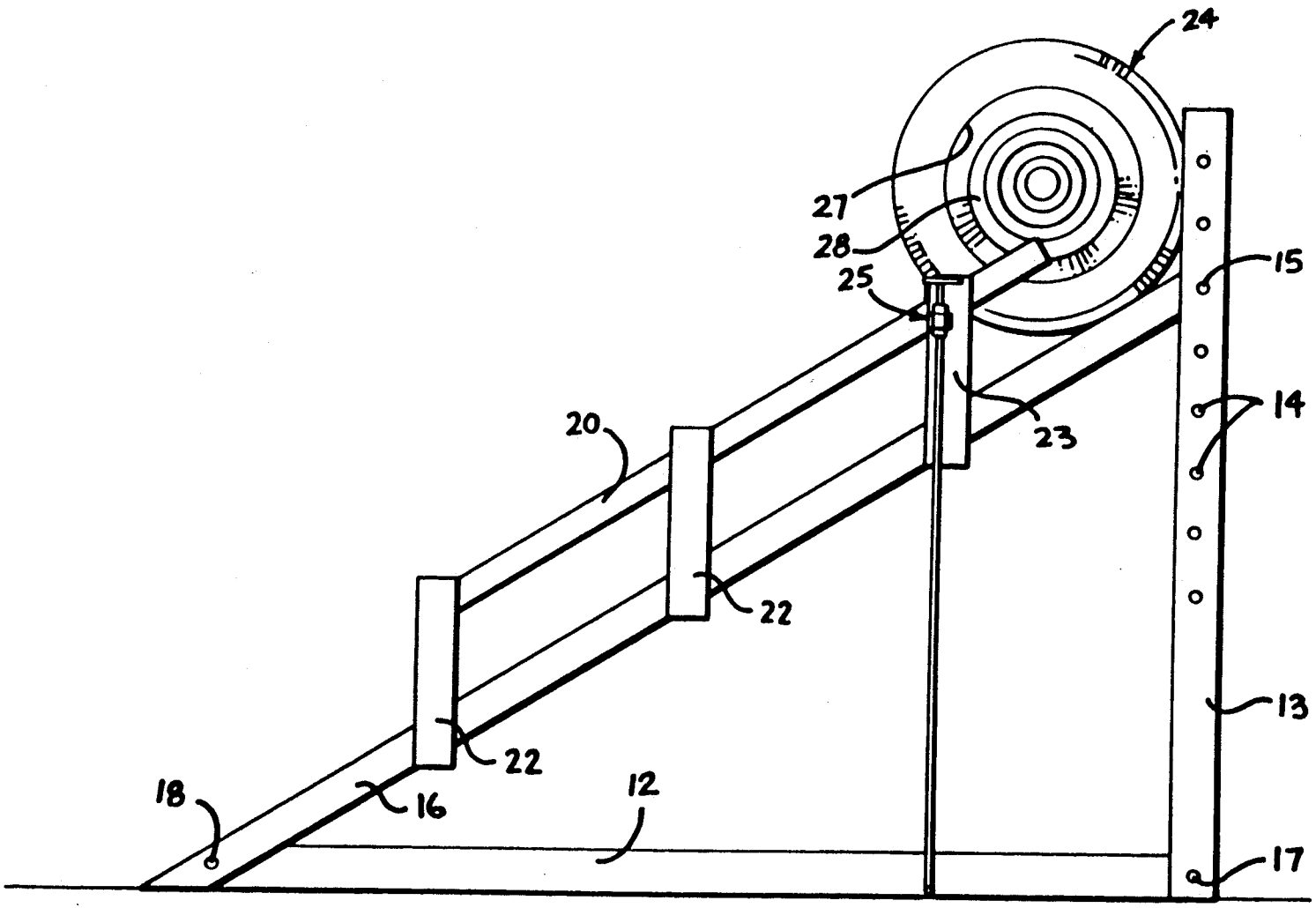
FIG. 2 is an orthographic view, taken along the lines 2—2 of FIG. 1 in the direction indicated by the arrows.
Figure 3:
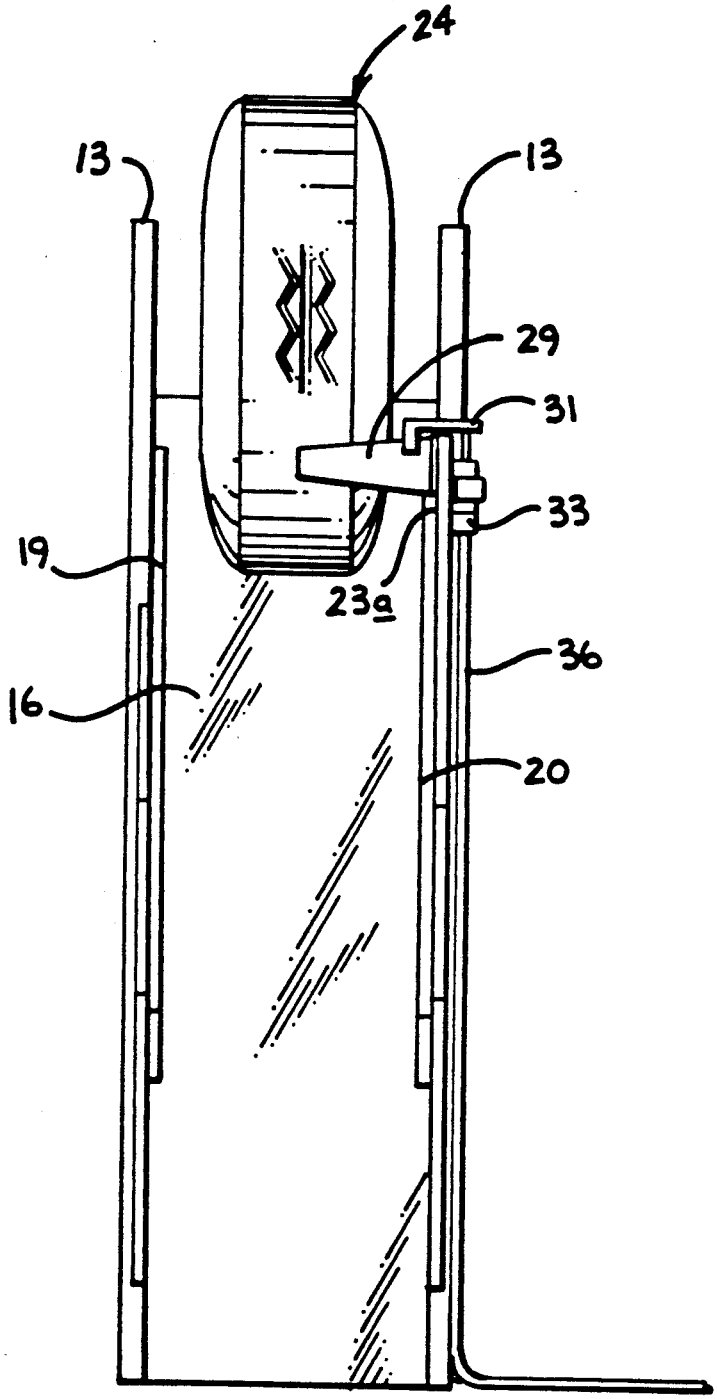
FIG. 3 is an orthographic view, taken along the lines 3—3 of FIG. 1 in the direction indicated by the arrows.
Figure 4:
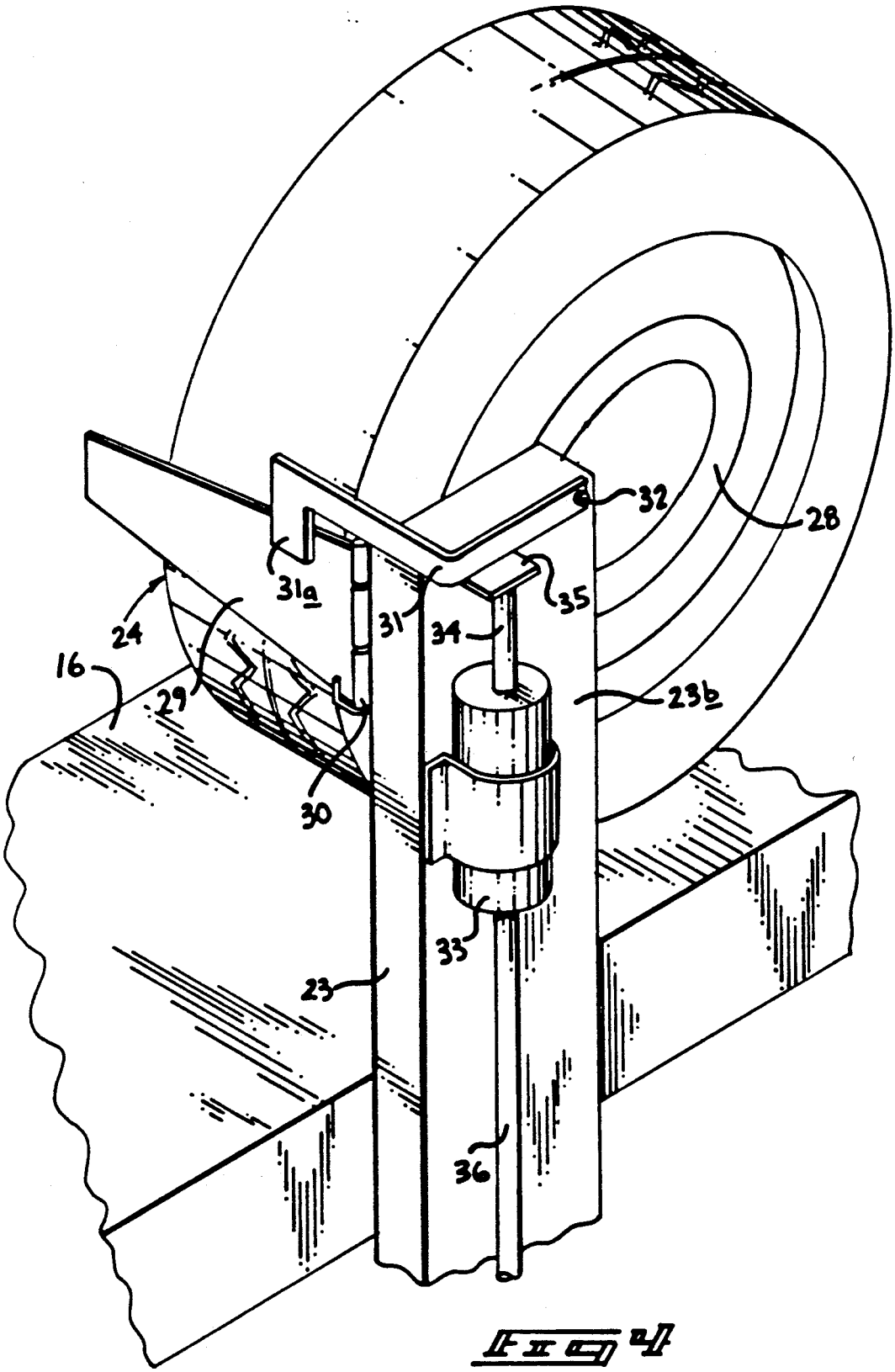
FIG. 4 is an isometric enlarged illustration of the latch mechanism utilized by the instant invention in association with a target.
Figure 6:
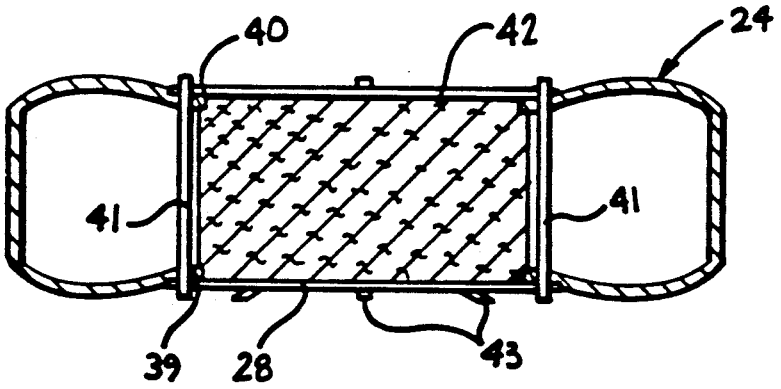
FIG. 6 is an orthographic view, taken along the lines 6—6 of FIG. 5 in the direction indicated by the arrows.
Figure 5:
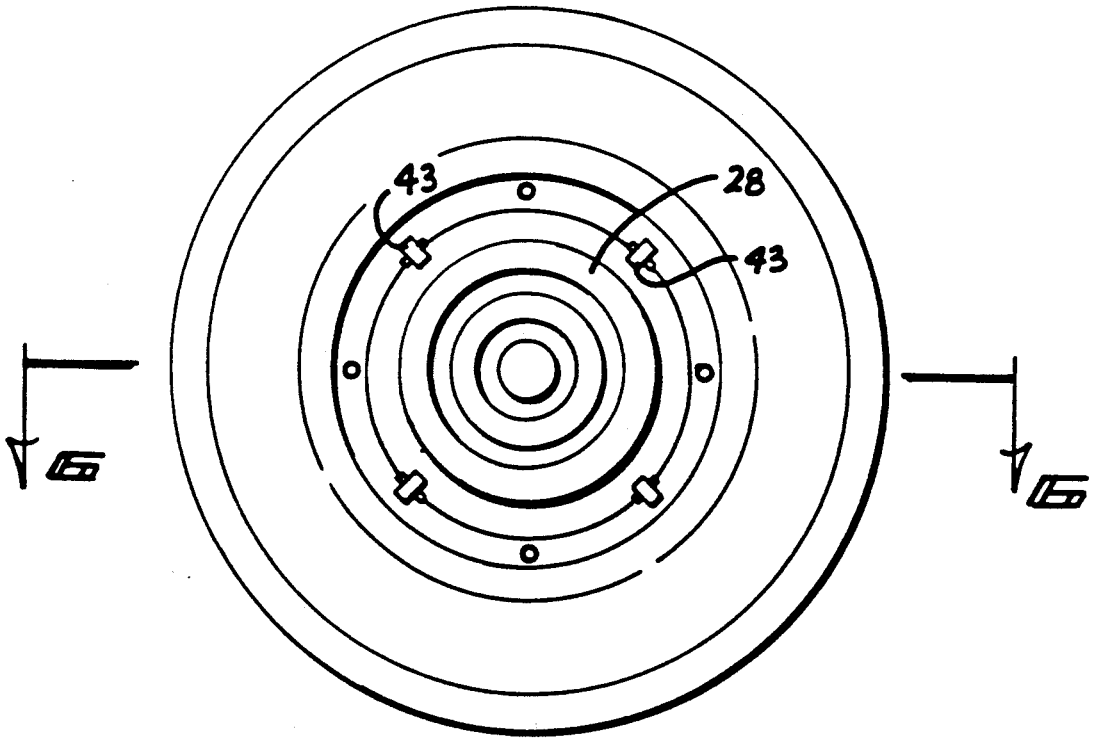
FIG. 5 is an orthographic side view of the tire target utilized by the instant invention.
Figure 7A:
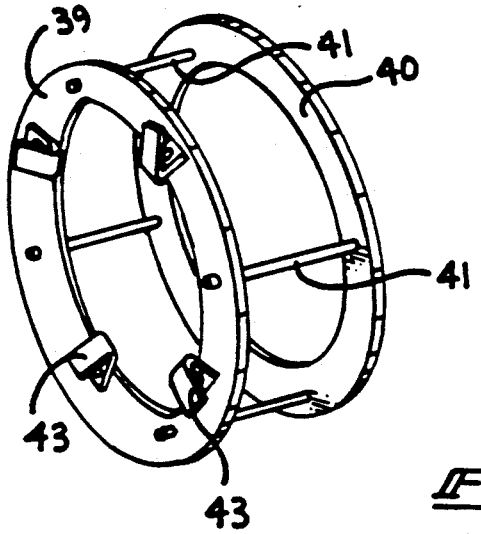
FIG. 7*a* is an isometric illustration of a target holder structure utilized by the invention

Reference to FIGS. 2-4 illustrate the latch mechanism 25 to include a gate flange 29 mounted to an upper terminal end of the top left support post 23 to an interior face 23*a* thereof by means of a spring hinge 30 to normally bias the gate flange 29 in a parallel relationship relative to the longitudinal extent of the ramp 16, wherein the gate flange 29 is maintained in an orthogonal relationship across the ramp 16 by an "L" shaped latch 31. The "L" shaped latch 31 is pivotally mounted by means of a pivot axle 32 that is orthogonally directed through the interior and rear faces 23*a* and 23*b* respectively of the top left support post 23 orthogonally oriented relative to the interior and rear faces thereof. The "L" shaped latch 31 includes a latch detent flange 31*a* mounted orthogonally relative to a forward terminal end of the latch 31 that projects over the ramp 16. A release cylinder 33 mounted to the rear face 23*b* includes a piston rod 34 and piston 35 mounted to an upper terminal end of the piston rod 34, wherein the piston 35 is positioned in engagement to a bottom surface of the "L" shaped latch 31. Upon actuation of the pneumatic pump 37, a pneumatic charge is directed through the pneumatic conduit 36 to effect extension of the piston rod 34 and associated piston 35 to effect upward projection of the "L" shaped latch 31 to thereby release the detent flange 31*a* relative to the gate flange 29 to thereby permit the spring hinge 30 to effect the pivotment of the gate flange 29 to a parallel relationship relative to the longitudinal extent of the ramp 16 and the interior face 23*a* of the top left support post 23. This operation permits the member 24 to roll downwardly along a top surface of the ramp 16. Reference to FIG. 7*a* illustrates the use of an outer torroidal plate 39 that are coaxially spaced and parallel relative to one another utilizing connecting ribs 41 to secure the outer and inner plates 39 and 40 together. The outer plate 39 includes a plurality of spring clips 43 to mount a target 28 thereon. If desired, a fibrous wadding 42 is contained between the plates 39 and 40 (see FIG. 6) to enhance securement of an arrow projected therewithin.

Figure 7:
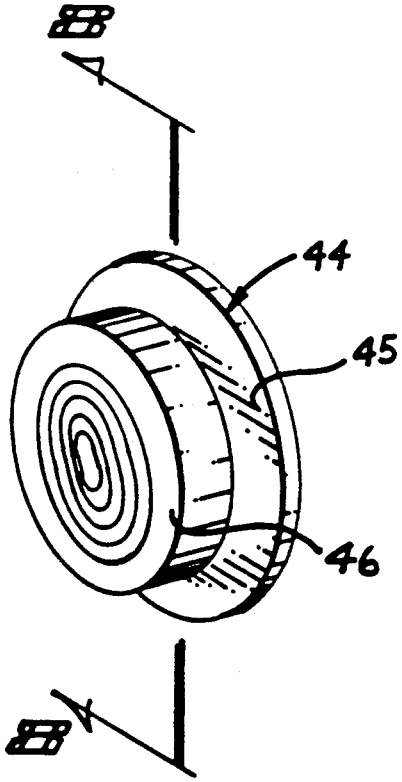
FIG. 7 is an isometric illustration of a target utilized and supported by the archery target structure, as illustrated in FIG. 7*a*.
Figure 8:
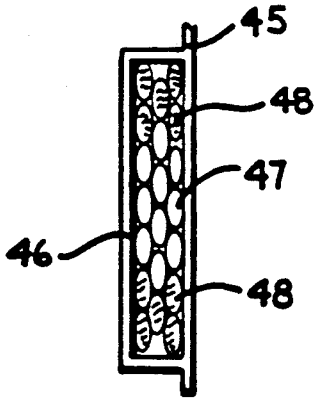
FIG. 8 is an orthographic view, taken along the lines 8—8 of FIG. 7 in the direction indicated by the arrows.

A modified target structure 44, as illustrated in FIG. 7, comprises an annular plate 45 mounting a cylindrical housing 46 thereon, with the annular plate 45 secured to the spring clips 43. The cylindrical housing 46 is formed of a fluid permeable fabric, with a respective first dye containing a plurality of capsules 47 centrally of the housing, with a plurality of second dye containing capsules 48 mounted peripherally about the central first dye containing capsules 47. The first and second dye capsules 47 and 48 utilize distinct colorations to visually indicate a central or peripheral impact of an arrow through the cylindrical housing 46 when mounted to the inner torroidal plate 40 by the spring clips 43. As illustrated, the annular plate 45 projects radially outwardly of the cylindrical housing 46 to provide a convenient flange support for mounting of the modified target 44.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An archery target apparatus, comprising, a support rack, the support rack including a plurality of horizontal base legs, each base leg including a rear base leg end and a forward base leg end, and each base leg mounting a rear mounting post orthogonally relative to each base leg rear terminal end at a rear mounting post lower terminal end, each rear mounting post arranged in a parallel relationship relative to one another, and each mounting post including a plurality of spaced apertures, with apertures of the plurality of spaced apertures of each mounting post arranged in a coaxial relationship relative to one another, and a ramp member, with the ramp member adjustably mounted relative to and between the rear mounting post, including a first pin connector directed through coaxially aligned apertures of the rear mounting posts for selective and adjustable securement of an upper portion of the ramp member between the rear mounting posts, and a ramp member lower end portion including a further pin connector directed through base leg forward terminal ends and a lower portion of the ramp member to secure the ramp member to the base legs, and a right rail mounted to and in a spaced relationship relative to the ramp member on a right side thereof, and a left rail mounted to the ramp member coextensive with the right rail in a spaced parallel relationship relative to the right rail, with the left rail mounted to a left side of the ramp member, and the left rail including a top left support post positioned adjacent the right member upper portion, and the top left support post including a latch mechanism, a release member in operative association with the latch mechanism to effect selective release of the latch mechanism, with a cylindrical tire member mounted rotatably relative to a top surface of the ramp member above the latch mechanism, whereupon selective actuation of the release member and release of the latch mechanism effects release of the tire member for rotation along a top surface of the ramp member.

2. An apparatus as set forth in claim 1 wherein the latch mechanism includes a release cylinder mounted to a rear face of the top left support post, the release cylinder including a piston rod reciprocatably mounted within a release cylinder, and the piston rod including a piston mounted to an upper terminal end of the piston rod, and a gate flange including a spring hinge mounted to a rear end of the gate flange, with the spring hinge mounted to an interior face of the top left support post, with the interior face of the top left support post in a spaced parallel relationship relative to the rear face of the top left support post, and the spring hinge arranged to bias the gate flange to parallel coextensive relationship relative to the interior face of the top left support post, and an "L" shaped latch mounted pivotally to the rear face of the top left support post, wherein the "L" shaped latch extends about the top left support post and extending orthogonally and forwardly of the interior face of the top left support post, wherein the "L" shaped latch includes a detent flange orthogonally and downwardly mounted to a forward terminal end of the "L" shaped latch positioned above the ramp member, wherein the detent flange is positioned to engage the gate flange in a first latched orientation, wherein the gate flange is oriented orthogonally relative to the interior face of the top left support post, and the release member includes a pneumatic pump, and the pneumatic pump in pneumatic communication with the release cylinder including a pneumatic conduit, whereupon actuation of the pneumatic pump effects projection of the piston relative to the release cylinder and projection of the "L" shaped latch and the detent flange above the gate flange to permit pivotment of the gate flange relative to the interior face of the "L" shaped support post.

3. An apparatus as set forth in claim 2 wherein the tire member includes a central opening, the central opening includes a target member secured therewithin, the target member includes an outer torroidal plate spaced from an inner torroidal plate, with a plurality of connecting ribs fixedly securing the outer torroidal plate relative to the inner torroidal plate in a spaced parallel relationship to complementarily position the outer torroidal plate and the inner torroidal plate interiorly and coaxially of the tire member, and the outer torroidal plate including a plurality of spring clips mounted to the outer torroidal plate, and a target member mounted to the spring clips.

4. An apparatus as set forth in claim 3 wherein the target member includes an annular plate secured to the spring clips, and the annular plate including a cylindrical housing positioned radially interiorly of the annular plate, with the cylindrical housing formed of a fluid permeable fabric and a plurality of first dye containing capsules of a first coloration contained centrally and coaxially of the cylindrical housing, and a plurality of second dye containing capsules contained peripherally about the first dye containing capsules of a second coloration.

* * * * *